United States Patent [19]

Vits

[11] Patent Number: 4,989,348

[45] Date of Patent: Feb. 5, 1991

[54] CONTINUOUS-FLOW DRYER FOR MATERIAL WEBS, IN PARTICULAR OFFSET DRYER PROCESS FOR THE THERMAL OPERATION OF A CONTINUOUS-FLOW DRYER

[76] Inventor: Hilmar Vits, Huschelrath 16, 5653 Leichlingen, Fed. Rep. of Germany

[21] Appl. No.: 194,594

[22] Filed: May 16, 1988

[51] Int. Cl.[5] ..... F26B 13/00

[52] U.S. Cl. ..... 34/155; 432/59

[58] Field of Search ..... 34/36, 37, 22, 155; 432/59

[56] References Cited

FOREIGN PATENT DOCUMENTS

| | | |
|---|---|---|
| 2300381 | 7/1975 | Fed. Rep. of Germany . |
| 2412446 | 9/1975 | Fed. Rep. of Germany . |
| 2501268 | 1/1976 | Fed. Rep. of Germany . |
| 2616347 | 4/1980 | Fed. Rep. of Germany . |
| 2948603 | 6/1981 | Fed. Rep. of Germany . |

*Primary Examiner*—Henry A. Bennet

*Attorney, Agent, or Firm*—Sprung Horn Kramer & Woods

[57] ABSTRACT

The invention relates to a dryer, in particular offset dryer for material webs containing high-boiling solvents to be dried in a continuous flow. The heating-up of the dryer atmosphere with a burner takes place in a closed chamber arranged in the dryer casing. Circulating air is fed to the burner as combustion air. Further circulating air, containing solvent vapors, is mixed in with the flue gas of the burner in the chamber in order that the solvent is completely burned. The temperature-controlled hot gases of the after-burning are cooled by mixing in fresh air at the inlet slit and, if appropriate, outlet slit to such a low temperature before they pass into the dryer interior that cracking of the volatile solvents in the circulating air of the dryer cannot occur. The volatile solvents, which can be used as fuel, can be extracted from the exhaust air, which like the circulating air only contains volatile solvents as pollutants, by cooling.

10 Claims, 1 Drawing Sheet

CONTINUOUS-FLOW DRYER FOR MATERIAL WEBS, IN PARTICULAR OFFSET DRYER PROCESS FOR THE THERMAL OPERATION OF A CONTINUOUS-FLOW DRYER

The invention relates to a continuous-flow dryer for material webs, in particular for offset printing, consisting of blowing nozzles applying heated air to one or both sides of the material web, at least one blower feeding the blowing nozzles with circulating air, at least one gas-fed heating device for the circulating air, at least one after-burning device for the circulating air containing pollutants as well as an inlet slit and an outlet slit for the material web, mixing chambers being provided at least on one of these slits above and below the material web guide plane, in which mixing chambers the fresh air streaming in via the inlet slit and., if appropriate, outlet slit is mixable with hot gases of the after-burning device and which have the outlets to the dryer interior.

The invention further relates to a process for the thermal operation of such dryers, in which the material webs give off high-boiling solvents into the dryer atmosphere during drying with air heated up by a gas burner applied to them, which solvents are fed to a thermal after-burning facility, from which the heat energy generated is used for the heating-up of the dryer atmosphere, fresh air entering at the dryer inlet slit and, if appropriate, the dryer outlet slit being mixed in with the hot gases as fresh air to be mixed in with the hot gases.

In the case of known dryers of this type (DE No. 26 16 347 B2), it is usual for the dryer atmosphere to be heated up by the flame of the gas burner burning openly into the dryer. Cracking of the high-boiling solvents getting into the dryer atmosphere produces pollutants which must not be expelled from the dryer into the atmosphere together with the solvent vapours without cleaning. Therefore, the exhaust air of the dryer is fed to a thermal after-burning facility. A proportion of these cleaned hot gases may be conducted back into the dryer atmosphere. However, the proportion of these cleaned hot gases is not passed directly into the dryer atmosphere, but only after mixing-in of fresh air in mixing chambers arranged at the inlet and outlet slits above and below the material web. In order that the energy requirement needed for the after-burning is kept small, a heat exchanger is provided in the after-burning device, by which the heat of the after-burning is recovered by the exhaust gas to be cleaned of the dryer being heated in the heat exchanger before it is fed to the after-burning facility. This type of cleaning of the exhaust air has a number of disadvantages: the heat exchanger suitable for after burning must be made of stainless steel. Such a stainless steel construction is expensive.

During rapid heating-up, high thermal stresses occur, which are accompanied by the risk of ruptures and cracks on the expensive heat exchanger. Finally, a great expense on pipes and control equipment is required.

In the case of another dryer (German Offenlegungsschrift 2,412,446), in which the fresh air enters the dryer atmosphere at the inlet and outlet slits without mixing-in of hot air, the heating-up of the dryer atmosphere takes place exclusively by means of a gas-heated after-burning device arranged in a chamber in the dryer. The hot gases of the after-burning device are applied to a heat exchanger, likewise arranged in the dryer, for the air to be heated up and fed to the blowing nozzles. The same difficulties exist in the case of this prior art as in the case of the prior art dryer of the same generic type, due to the heat exchanger. A further disadvantage of this known apparatus is that, due to the heat exchanger, the dryer atmosphere cannot be heated up quickly enough. Since the heat exchanger must be in operation during heating-up of the dryer atmosphere) in order to be able to supply heated-up air to the blowing nozzles for the purpose of even heating of the dryer atmosphere, a rapid heating-up can only be achieved with an increased throughput of air heated-up by the after-burning. Since, however, the circulating-air blower is designed for the normal throughput volume, it cannot supply this increased air throughout. In order to achieve the desired rapid heating-up capacity, the heating-up capacity would have to be increased by two to three times that of normal operation. This would necessitate a circulating-air blower of about ten times higher power. The constructional expense would be correspondingly great.

The invention is based on the object of improving a continuous-flow dryer and a process for the thermal operation of continuous-flow dryers for material webs with regard to the heating-up of the dryer atmosphere with special consideration for the production of pollutants.

This object is achieved in the case of a continuous-flow dryer of the type mentioned at the beginning in that each heating device and after-burning device fed with gas and circulating air of the dryer is combined into a unit and has a closed combustion chamber in the dryer casing.

As far as the process is concerned, this object is achieved with a process of the type mentioned at the beginning by the following features:

(a) the heating-up of the dryer atmosphere takes place exclusively together with the after-burning within the dryer in a gas-heated combustion space partitioned off from the dryer atmosphere;

(b) all hot gases generated during heating-up and after-burning, used for the heating-up of the dryer atmosphere, are cooled by mixing-in of fresh air before they are conducted into the dryer atmosphere.

With the invention, there is no longer the risk of cracking of the solvents in the dryer atmosphere which have become volatile during drying, because the dryer atmosphere does not come into contact directly with very hot elements, in particular not with a flame openly burning into the dryer. Since the heating and after-burning device uses circulating air from the dryer atmosphere, it is ensured that the combustible constituents of the solvents which have become volatile contained in this diverted circulating air are completely burned. Since, furthermore, the hot gases of the after-burning are first cooled to an uncritical temperature by mixing-in of fresh air before then pass into the dryer atmosphere, it is ensured that these hot gases also do not come into contact with the circulating air in the dryer atmosphere containing the combustible substances. Therefore, in this case as well cracking and thus the production of pollutants does not occur. Since the circulating air containing the combustible substances is fed to the heating and after-burning device, there is a saving of auxiliary energy otherwise required for the heating-up of the dryer atmosphere. These advantages are achieved without requiring for heat recovery, as in the prior art, the expense of a heat exchanger downstream of the after-burning facility together with its pipe work and control equipment. The mixing-in of hot gases at the inlet and outlet slits also has the effect of reducing the volume of fresh air to be taken in due to the negative pressure, and thus also the volume of exhaust air to be removed from the dryer, which is often associated with a loss of thermal energy.

The absence of the heat exchanger has the further advantage that, without additional expense, the dryer atmosphere can be heated up rapidly. Without the heat exchanger it is namely not necessary to install a circulating-air blower of increased power.

According to a development of the invention, the temperature of the dryer atmosphere is controlled by the rate of air to be fed to the heating device. By the use of a proportional control, it can be achieved in a simple way that the rate of gas follows the controlled rate of air.

The temperature of the hot gases of the after-burning is preferably controlled via the rate of air to be fed to the after-burning facility from the dryer.

Since, in the case of the invention, the dryer atmosphere is free from pollutants but not free from solvents, the solvents from the exhaust air of the dryer can be obtained by cooling of the exhaust air, since these solvents condense during cooling. These solvents can be collected and used as fuel. A comparison of calorific values shows that the calorific value of the condensate obtained from the exhaust air is equivalent to the calorific value of the gas fed to the heating device. The expenditure on thermal energy is physically covered by the solvents contained in the printing ink applied to the material web.

The invention is explained in more detail below with reference to a drawing diagrammatically representing a continuous-flow dryer and in which, specifically:

Figure 1:
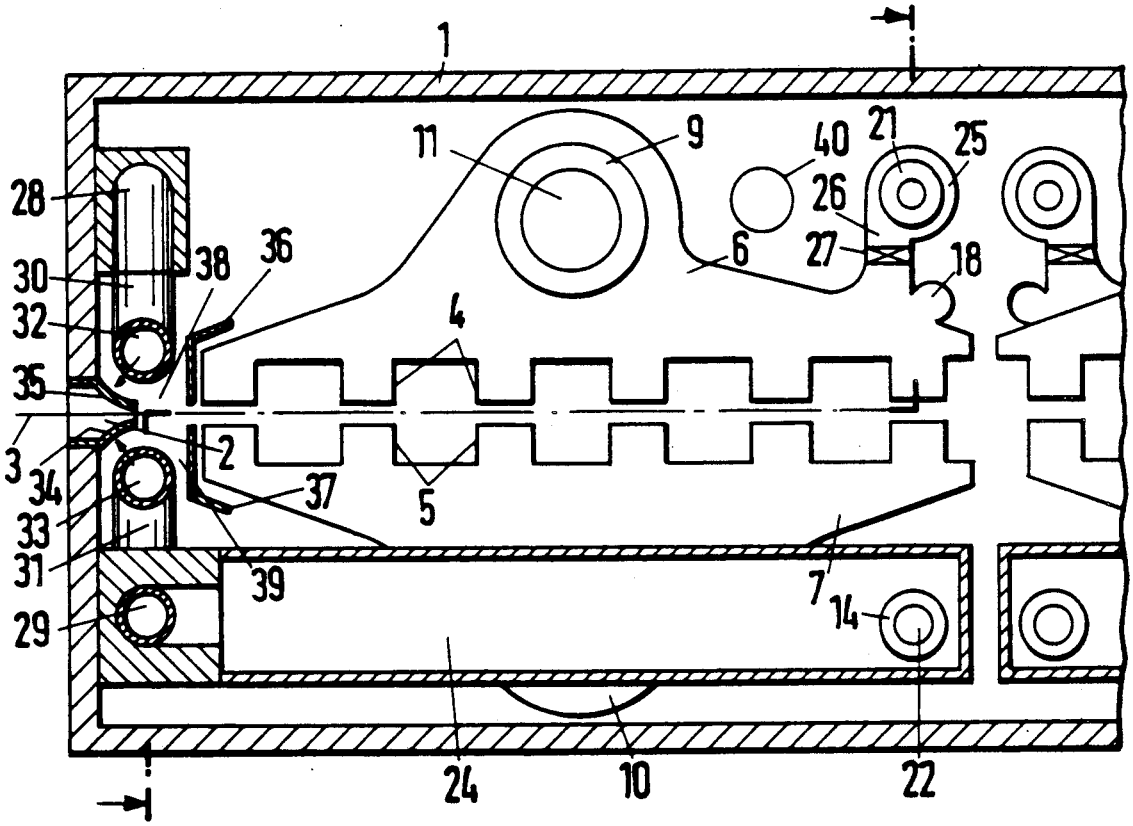
FIG. 1 shows a dryer with its first zone and a part of its second zone in longitudinal section along the line A-B of FIG. 2.
Figure 2:
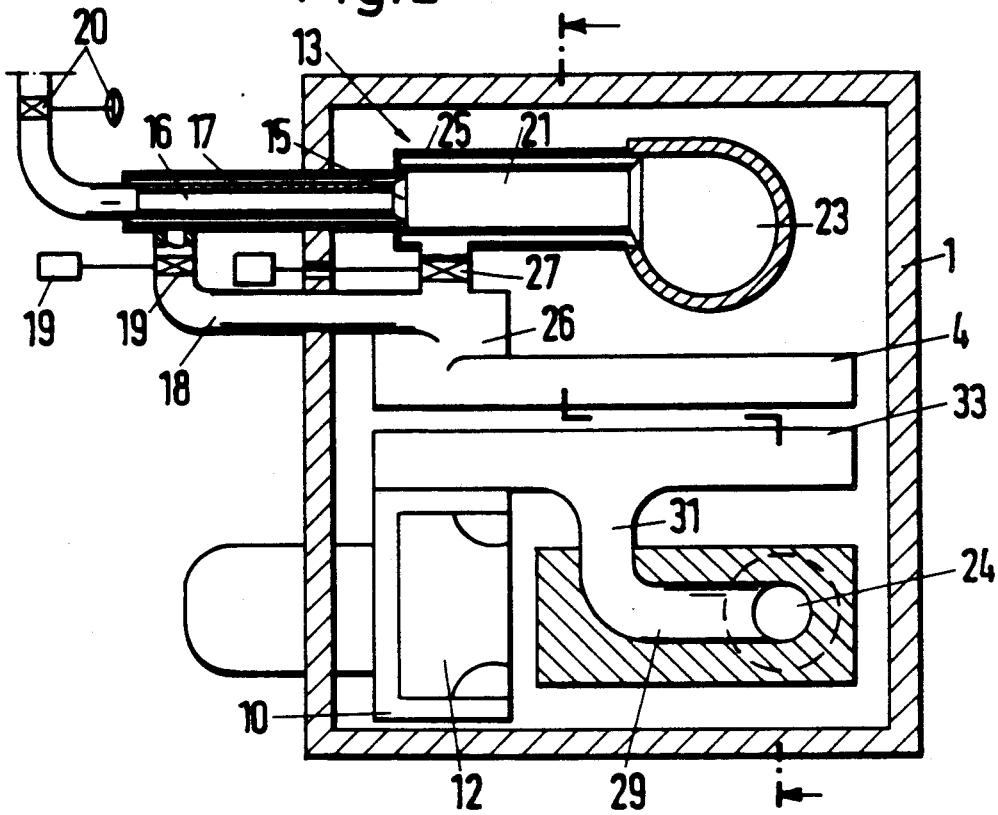
FIG. 2 shows the dryer according to FIG. 1 in cross-section along the line C-D of FIG. 1.

A dryer casing 1 has on its front end wall an inlet slit 2 for a material web 3 to be dried. A corresponding outlet slit is provided on its rear end wall (not shown). Heated-up air is blown onto the material web 3 during passage through the dryer and it is thereby suspended and dried. For this purpose, a multiplicity of nozzle boxes 4, 5, for example air cushion nozzles, are provided above and below the material web 3, extending transversely to the material web running direction and fed with heated blowing air. These air cushion nozzles 4, 5 are fed via a common duct 6, 7 from a blower 9, 10, which takes in air from the dryer atmosphere via an intake opening 11, 12.

The heating-up of the dryer atmosphere takes place exclusively by a heating and after-burning device forming a unit. Such a heating and after-burning device is provided for each zone above and below the material web 3. It consists of a burner 13, 14, to the burner mouth 15 of which gas is fed via a central pipe 16 and air is fed via a ring duct 17 surrounding this pipe 16. The air feed takes place via a pipe 18 from the duct 6, 7. In the pipe 18 there is provided a motor control valve 19, which is controlled as a function of the temperature of the dryer atmosphere. The feed of gas is controlled by an equal-pressure control valve 20 to the control diaphragm of which air pressure in the ring duct 17 is applied on one side. The equal-pressure control valve 20 is designed in such a way that, by controlling the air fed to the burning 13 by the motor-control valve 19, a proportional control of the rate of gas takes place.

The burner 13 has a combustion chamber 21, 22, which opens out eccentrically from the side into a second larger combustion chamber 23 extending over the length of the zone. The combustion chamber 21, 22 is surrounded by a ring duct 25, which is connected to the duct 6, 7 via a pipe 26. The feed of circulating air to the ring duct 25 is controlled by means of a motor-control valve 27 arranged in the pipe 26 as a function of the temperature in the combustion chamber 21, 22. The hot flue gases of the combustion chamber 21, 22 and the air fed via the ring duct 25 are mixed at the end of the combustion chamber 21, 22 and enter eccentrically from the side into the combustion chamber 23, 24. A spiral flow through the combustion chamber 23, 24 from one end to the other is then produced.

At the other end of the combustion chamber 23, 24, the hot gas passes via a bend 28, 29 and a pipe 30, 31 into a nozzle tube 32, 33 extending transversely to the material web. From the nozzle holes arranged in series in this nozzle tube 32, 33 there are discharged blowing jets which blow against a baffle plate 34, 35, which is curved convexly with respect to the material web 3 and increasingly approaches the material web in the material web running direction. Assigned to the edge of this baffle plate 34, 35 opposite the casing interior, is a guide plate 36, 37 not far away from the material web 3. Together with the baffle plates 34, 35 and the casing wall at the end, this guide plate 36, 37 forms a duct 38, 39.

By this special design at the inlet slit 2, which may also be provided at the outlet slit, the hot gases of the heating and after-burning facility are mixed with the fresh air streaming in via the slit 2 and thereby reduced to a temperature-re uncritical for a cracking of the volatile substances. In addition, it is prevented that cold fresh air passes directly into the interior of the dryer. After mixing, the hot gases and the fresh air pass via the duct 38, 39 into the interior of the dryer.

The operation of the dryer takes place in the following way. During heating-up, in other words with cold dryer atmosphere, the motor-control valve 19 is controlled in such a way that a high rate of gas is fed via the equal-pressure valve 20 and a rapid heating-up takes place in this way. At this time, there are still no volatile substances in the circulating air. The flue gas volume of the combustion chamber 21, 22 and similarly the circulating-air volume fed to the relatively long second combustion chamber (after-combustion chamber) 23, 24 via the ring pipe 25 are in this case great. The fed circulating air serves in this case predominantly for the cooling of the flue gases, to be precise by the mixing-in taking place.

On reaching the operating temperature of the dryer atmosphere, the air and gas feed of the burner adjusts to the lower heat requirements during starting-up of the system. Due to the then lower fuel gas volume from the combustion chamber 21, 22, although a proportionately smaller volume of the circulating air which is to be fed to the after-combustion chamber 23, 24 and controllable via the control valve 27 would suffice, due to the higher temperature in the meantime of the circulating air to be fed via the ring pipe and the associated lower cooling effect, the delivery of circulating air into the after-combustion chamber does not drop to the same extent.

The solvent vapours then being produced constantly at the beginning of drying and getting into the dryer atmosphere allow their concentration in the dryer atmosphere to increase. These combustible substances present in the dryer atmosphere, which are fed with the circulating air drawn off from the dryer to the after-combustion chamber 23, 24 are burned here. This has the advantage that the thermal energy thereby generated leads to a corresponding reduction in the heating output of the burner 13. Due to the consequent lower heating output of the burner 13, the circulating-air volume fed to the after-combustion chamber 23,24 is reduced, so that the residence time of the circulating air in the after-combustion chamber is sufficiently long for a good burn-up of the combustible substances and for a high purity of the circulating air.

The self-supply of the dryer with thermal energy is limited by an exhaust air volume reduced to a fraction of that of conventional dryers. The exhaust air volume cannot however be reduced to zero, because it is necessary to keep the dryer atmosphere at an adequate oxygen-containing level for operation of the burner by taking in fresh air, for example via the inlet and outlet slits of the dryer. Furthermore, a certain exhaust air volume is necessary in order to keep the dryer under a negative pressure so that the vapour-containing atmosphere of the dryer does not escape into the atmosphere via the dryer slits.

The exhaust air produced during the operation of the dryer according to the invention differs from the conventional dryers by a lower exhaust air volume, the exhaust air still containing oil vapour but being free from pollutants (cracked substances). The cleaning of the exhaust air can therefore be carried out by condensation, i.e. with the recovery of solvents which can be used as fuel.

I claim:

1. A continuous-flow dryer for a material web comprising within a dryer casing one or more blowing nozzles for applying heated air to one or both sides of the material web, with at least one blower feeding the blowing nozzle with recirculated air within the interior of the dryer casing, at least one gas-fired heating device for the recirculated air and an after-burning device, as well as an inlet slit through said casing and an outlet slit through said casing for the material web, mixing chambers being provided adjacent to at least one of said slits above and below the material web, an outlet of the after-burning device being connected to a discharge device at the inlet slit for mixing the hot gases of the after-burning device with fresh air streaming in via the inlet slit and which have the outlets to the dryer interior, wherein each heating device and after-burning device fed with gas and said recirculated air is combined into a unit and has a closed combustion chamber in the dryer casing.

2. A continuous flow dryer according to claim 1, wherein the recirculated air is fed to the burner of the heating and after-burning device as combustion air is controlled as a function of the temperature of the dryer atmosphere and the gas fed to the burner is controller rate-proportionally.

3. A continuous flow dryer according to claim 1 or 2, wherein the heating and after-burning device has a first combustion chamber and a second combustion chamber arranged one behind the other, feeding said recirculated air to the second combustion chamber as a function of the temperature at the end of the second combustion chamber.

4. A process for the thermal operation of a continuous-flow dryer for material webs which give off high-boiling solvents into the dryer atmosphere during drying, with air heated up by a gas burner applied to them, which solvents are fed to a thermal after-burning facility, from which the heat energy generated is used for the heating-up of the dryer atmosphere, fresh air, entering at a dryer inlet slit being mixed in with the host gases comprising (a) the heating-up of the dryer atmosphere taking place exclusively together with the after-burning within the dryer in a gas-heated combustion space partitioned off from the dryer atmosphere; and (b) cooling all hot gases generated during heating-up and after-burning used for the heating-up of the dryer atmosphere, by the mixing-in of fresh air before they are conducted into the dryer atmosphere.

5. A process according to claim 4, wherein the rate of air to be fed to the burner of the heating device is controlled as a function of the temperature of the dryer atmosphere.

6. A process according to claim 4, wherein the air to be fed to the combustion chamber of the after-burning facility from the dryer is controlled as a function of the temperature of the hot gases of the after-burning facility.

7. A process according to claim 4, wherein the exhaust air of the dryer is cooled and the solvents thereby condensing are collected.

8. A process according to claim 4, wherein at least a fraction of the exhaust air is guided into the heating device via a channel and the other fraction is lead away to the outside of the dryer.

9. The continuous-flow dryer of claim 1 further comprising the outlet of the after-burning device being connected to a discharge device at an outlet slit for mixing the hot gases of the after burning device with fresh air streaming in via said outlet slit.

10. The process for thermal operation of a continuous-flow dryer of claim 4 further comprising fresh air entering said continuous-flow dryer at an outlet slit.

* * * * *